US006300603B1

(12) United States Patent
Edwards et al.

(10) Patent No.: US 6,300,603 B1
(45) Date of Patent: Oct. 9, 2001

(54) STOVETOP BURNER WITH SAFETY FEATURE

(76) Inventors: Stephen Patrick Edwards, 941 SE. 14 Ter., Deerfield Beach, FL (US) 33441; Christopher Charles Edwards, 139 Carson Rd., Brooks, GA (US) 30205

( * ) Notice: Subject to any disclaimer, the term of this patent is extended or adjusted under 35 U.S.C. 154(b) by 0 days.

(21) Appl. No.: 09/588,919

(22) Filed: Jun. 8, 2000

(51) Int. Cl.[7] ..... H05B 3/68; H05B 1/02
(52) U.S. Cl. ..... 219/447.1; 219/518
(58) Field of Search ..... 219/446.1, 447.1, 219/518, 519

(56) References Cited

U.S. PATENT DOCUMENTS

| | | | | |
|---|---|---|---|---|
| 2,497,753 | | 2/1950 | Arnot | 219/25 |
| 3,134,007 | * | 5/1964 | Niblo | 219/447.1 |
| 3,796,850 | | 3/1974 | Moreland, II et al. | 219/10.49 |
| 3,993,885 | | 11/1976 | Kominami et al. | 219/10.49 |
| 4,319,109 | | 3/1982 | Bowles | 219/10.49 R |
| 5,296,684 | | 3/1994 | Essig et al. | 219/518 |
| 5,466,915 | | 11/1995 | Meier et al. | 219/622 |
| 6,031,209 | * | 2/2000 | Wiesman | 219/447.1 |

* cited by examiner

*Primary Examiner*—Sang Paik
(74) *Attorney, Agent, or Firm*—Baker, Donelson, Bearman & Caldwell

(57) ABSTRACT

A stovetop burner has an electromagnet and safety control means for enabling burner operation only when the electromagnet is energized to hold a cooking utensil on the burner.

10 Claims, 4 Drawing Sheets

STOVETOP BURNER WITH SAFETY FEATURE

TECHNICAL FIELD

This invention relates to stovetop burners such as electric and gas burners of kitchen ranges.

BACKGROUND OF THE INVENTION

Kitchen ranges commonly have a stovetop with several individual burners upon which cooking utensils may be set for cooking their contents. The burners are usually either electric or gas. Where they are electric they commonly have an electric resistance heating element in the shape of a flat spiral or coil. A cooking utensil such as a pot or pan is set directly on the heating element. Gas burners usually have an annular jet that is recessed below a support grill upon which the cooking utensil is set.

Being hot, stovetop burners inherently are hazardous. One may touch the electric heating element not realizing that it is hot. The flame from a gas jet may actually ignite the sleeve of a garment. More importantly, a hot pot or pan may be tipped by accidental contact with its handle. Small children may reach up and grab a pot handle and cause the pot to tip and its contents to pour. Handicapped people, such as those confined to wheelchairs, also are susceptible to such accidents. In some cases even large dogs have been known to have done this. When this occurs, not only may the hot utensil contact and burn the child, adult or pet, its hot contents can also make such bodily contact.

It thus is seen that a need exists for safer stovetop burners. Accordingly, it is to the provision of such that the present invention is primarily directed.

SUMMARY OF THE INVENTION

In a preferred form of the invention, a stovetop burner has a gas or electric heat generating element. An electromagnet is mounted adjacent to the heating element. A safety control circuit is provided for enabling operation of the heat generating element only while the electromagnet is energized for holding a cooking utensil upon the heat generating element.

The burner may also have means for detecting the presence of a cooking utensil upon the heat generating element. In that case the safety control circuit enables operation of the het generating element only while the sensor detects the actual presence of a utensil. The detection means itself includes a switch positioned adjacent the heating element for movement by the cooking utensil to a closed position as the utensil is set upon the heating element.

DETAILED DESCRIPTION

Figure 1:
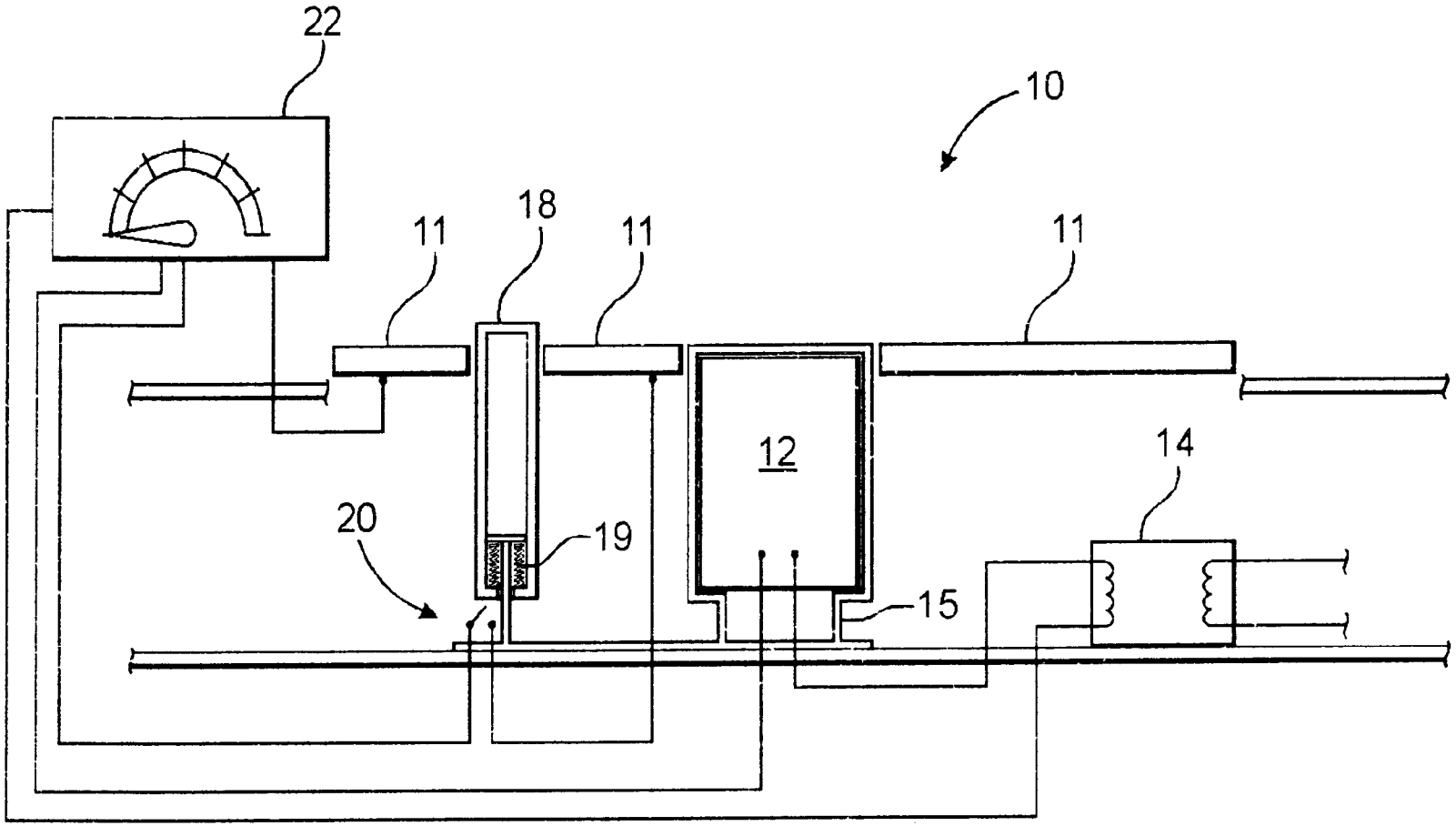
FIG. 1 is a schematic diagram of a stovetop burner of the present invention.
Figure 2:
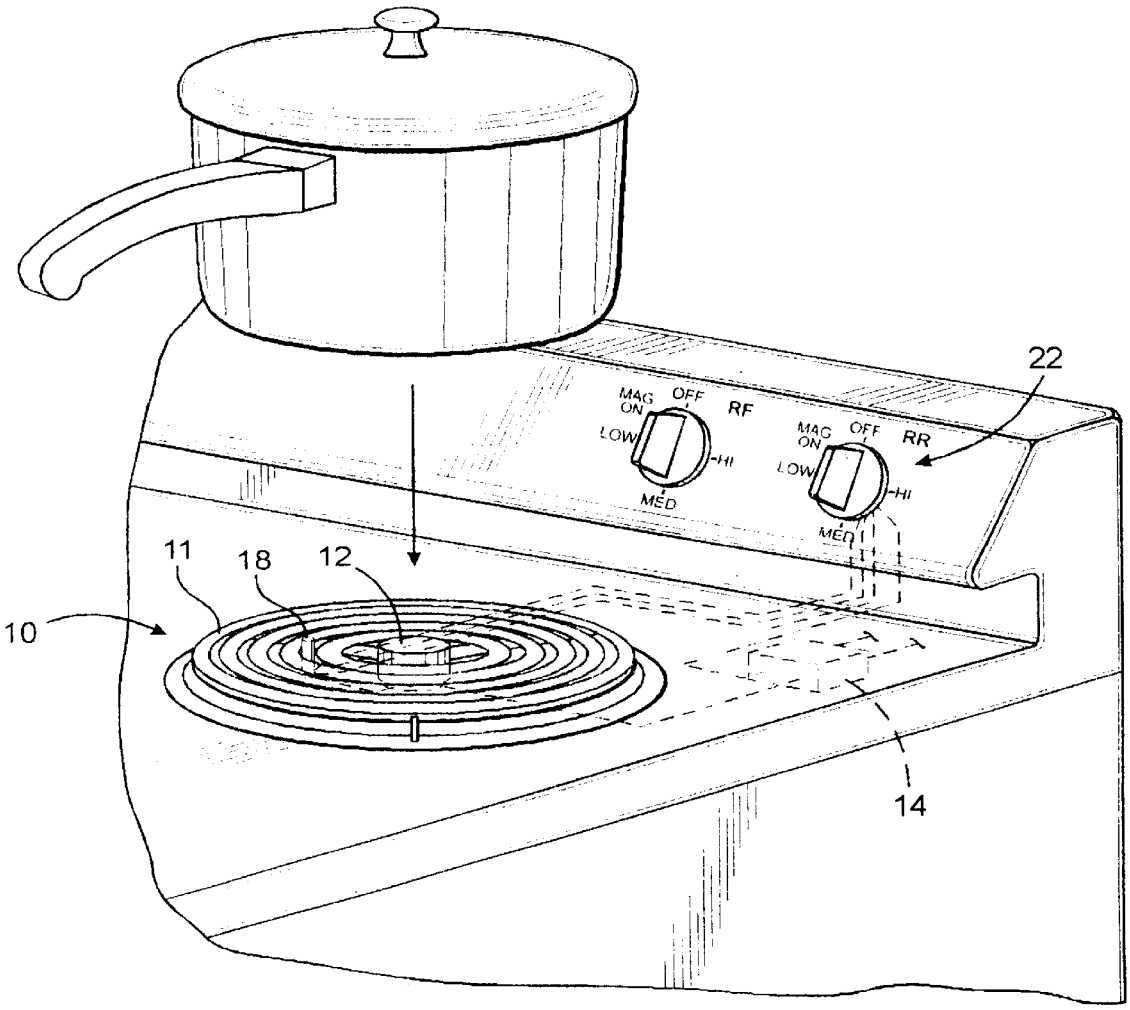
FIG. 2 is a perspective view of the stovetop burner of FIG. 1 with a pot shown positioned over the burner.
Figure 3A:
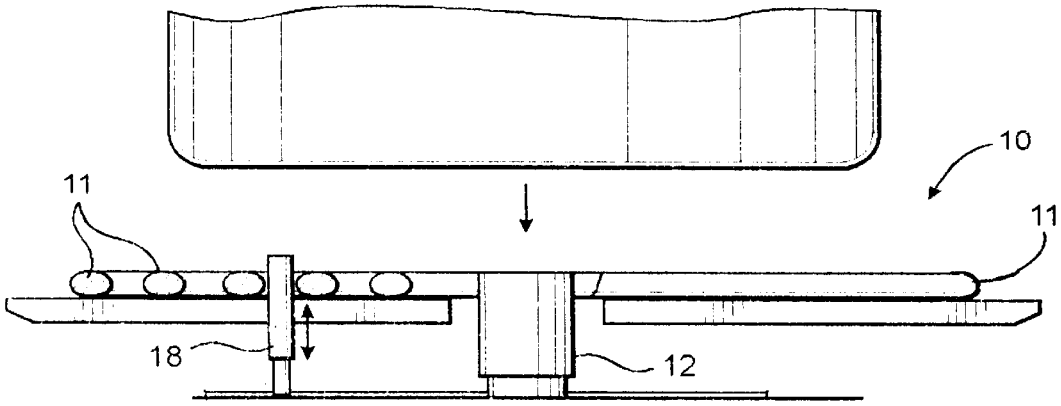
FIGS. 3A and 3B are side views showing depression of a plunger as a pot is set upon the burner.
Figure 3B:
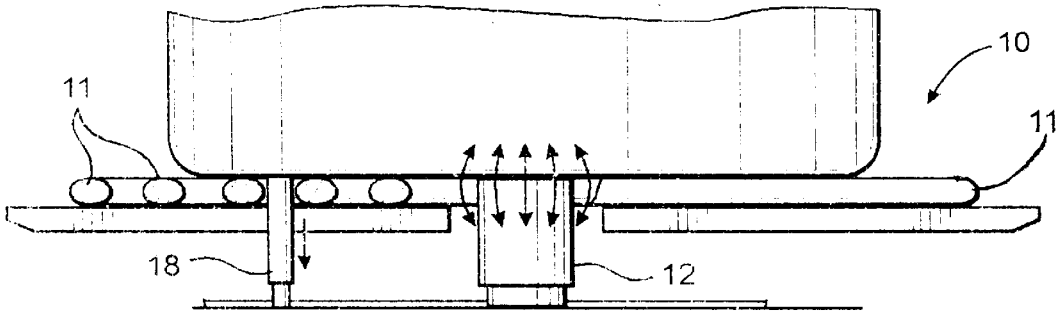

With reference next in more detail to the drawings, there is shown in FIGS. 1–3 a stovetop burner 10 that has a conventional coiled electric heat resistant element 11. An electromagnet 12 is rigidly mounted in the center of the heating element. The electromagnet is of a heat resistant type such as Product No. CEX-300-12C sold by the AEC Magnetics Division of Automatic Equipment Corporation of Cincinnati, Ohio. It can withstand temperatures to 400° F. If desired, its top may be covered with a sheet of thin veneer for washability. Its sides may also be covered with thermal insulation. The burner also has a plunger 18 that is biased upwardly to the position shown in FIGS. 1 and 3A by tension springs 19. The top of the plunger is biased to a position a little above the top surface of the heating element 11. It is mounted for downward movement in response to placement of a cast iron or other ferromagnetic cooking utensil on the heating element. Note that in its depressed, lower position shown in FIG. 3B it closes an electric plunger switch 20.

The electric heating resistance element 11 is connected with an unshown power source through a conventional control switch 22 mounted on the stove console. The switch includes a rheostat so that the heating element can be energized at various levels of power, as is conventional. In this case however the switch 22 is normally ineffective in connecting the heating element 11 with power. This is due to the presence of the plunger switch 20 being open and in series circuit with the control switch 22. Moreover, another in-series electromagnet switch, shown only in FIGS. 1 and 2 as MAG ON, must also be closed before the heating element can be energized. The MAG ON switch can also only be activated when plunger switch 20 is closed. When the MAG ON switch is closed the electromagnet is connected to power through a power adaptor 14 which converts municipal power to low voltage d.c. such as 12 volts d.c.

So constructed it is seen that the heating element 11 can be energized only when both the plunger switch 20 is closed and the electromagnet is switched on. For these two conditions to be met, a cooking utensil must be both on the burner, covering the heating element, and therefore held thereto by the electromagnet. Thus one cannot accidently touch the heating element 11 while it is energized. Nor can one accidently knock a ferromagnetic pot or pan off the heating element while it is energized since it is held thereto by the electromagnet as indicated by the arrows in FIG. 3B. Though preferred, it is not essential to have the plunger to detect the actual presence of the utensil. Nevertheless in that case the heating element still cannot be energized until the MAG ON switch is closed. Additionally, the electromagnet itself could serve as the plunger by mounting it for limited spring biased movement in actuating the switch. The burner or other element may also serve as a plunger. Any other sensor that detects the presence of the in-place cooking utensil could activate the described safety elements.

Figure 4A:
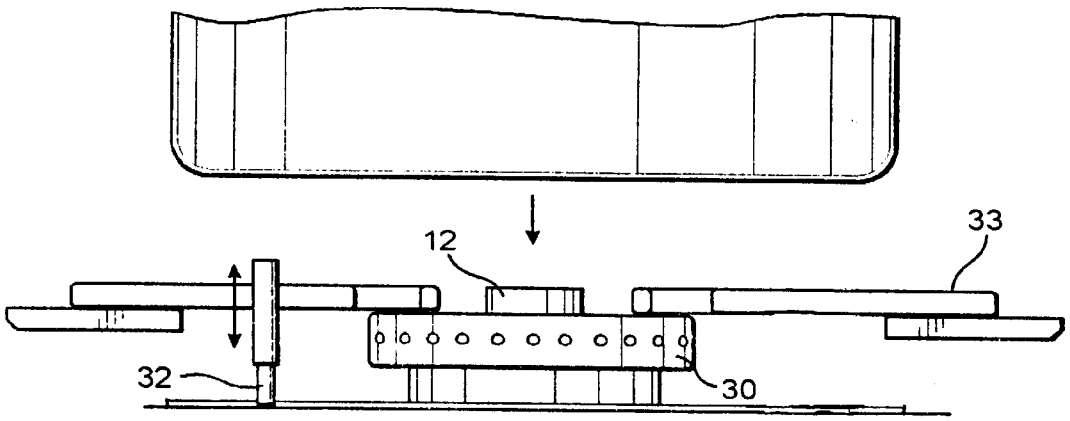
FIGS. 4A and 4B show a pot being set upon a gas type stovetop burner that also incorporates principles of the invention.
Figure 4B:
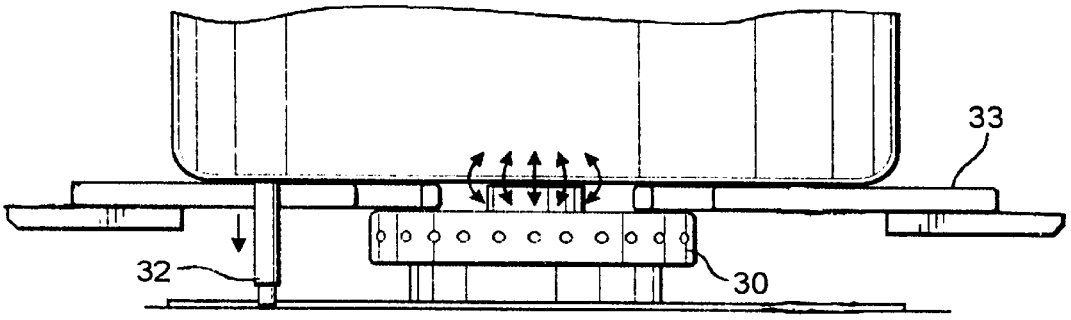

FIGS. 4A and 4B illustrate a stovetop burner of a type that has a gas operated heater 30 that emits an annular flame from an annular array of jets. In this case the stovetop burner is provided with a centrally mounted electromagnet 12. The electromagnet is again operated by a switch as previously described which must be closed before the gas ignitor is made operational. Again, the gas-on switch is rendered effective in spark igniting the gas when the plunger 32 here is depressed by a ferromagnetic pot or pan or the like and the MAG ON switch is closed.

It thus is seen that a stovetop burner is now provided that is safer to operate than those of conventional construction. When the stove is on, be it electric or gas, a magnetic field is generated that holds any cooking utensil made of ferromagnetic material in place over the heat source. To dissipate this magnetic field in order to remove the utensil, the stove burner itself must normally be turned off.

The magnetic field is preferably provided by an electromagnet although a permanent magnet could be substituted. In that case a moveable pole piece would be employed to shunt the magnetic flux in releasing the pot. However, an electromagnet is strongly preferred for a number of reasons.

Although the invention has been described and illustrated in its preferred form, it should be understood that many modifications, changes or additions may be made without departure from the spirit and scope of the invention as set forth in the following claims.

What is claimed is:

1. A stovetop burner having a heat generating element, an electromagnet mounted adjacent said heat generating element, and safety control means for enabling operation of said heat generating element only while said electromagnet is energized for holding a cooking utensil upon the heat generating element.

2. The stovetop burner of claim 1 wherein said heat generating element is an electrical resistance element.

3. The stovetop burner of claim 2 wherein said electrical resistance element is a coil and wherein said electromagnet is located centrally within said coil.

4. The stovetop burner of claim 1 wherein said heat generating element is a gas burner.

5. The stovetop burner of claim 4 wherein said gas burner has an annular array of jets and wherein said electromagnet is located centrally within said annular array of jets.

6. The stovetop burner of claim 1 wherein said safety control means comprises means for detecting the presence of a cooking utensil upon said heat generating means.

7. The stovetop burner of claim 1 wherein said safety control means comprises an electric circuit with a switch positioned adjacent said electromagnet for movement to a closed position by the weight of a cooking utensil position on said heat generating element.

8. The stovetop burner of claim 7 further comprising a plunger spring biased to an unloaded position above said heat generating element and wherein said switch is located in operative association with said plunger.

9. A stovetop burner having a heat generating element, an electromagnet mounted adjacent said heat generating element, and electric circuit means for coupling said heat generating element and said electromagnet to a power source with said heat generating element coupling being conditioned on said electromagnet being coupled.

10. The stovetop burner of claim 9 wherein said heat generating element is an electric resistance coil and wherein said electromagnet is mounted centrally within said electric resistance coil.

* * * * *